United States Patent [19]

Gray et al.

[11] Patent Number: 4,643,160

[45] Date of Patent: Feb. 17, 1987

[54] BOW SIGHT

[76] Inventors: Richard L. Gray, 07695 Hwy. 126, Florence, Oreg. 97439; George M. Howard, Box 23, Blachly, Oreg. 97412

[21] Appl. No.: 654,964

[22] Filed: Sep. 27, 1984

[51] Int. Cl.[4] ..... F41B 5/00; F41G 1/00

[52] U.S. Cl. ..... 124/87; 33/265; 124/DIG. 1; 124/90

[58] Field of Search ..... 124/88, 87; 33/265, 33/424, 426, 497, 499, 500; 403/92, 94, 96, 97

[56] References Cited

U.S. PATENT DOCUMENTS

| | | | |
|---|---|---|---|
| 2,667,692 | 2/1954 | Leafstrand | 33/265 |
| 3,013,336 | 12/1961 | Pennington | 33/265 |
| 3,271,863 | 9/1966 | Harrington | 33/265 |
| 3,521,362 | 7/1970 | Duplechin | 33/265 |
| 3,718,979 | 3/1973 | Allen | 33/265 |
| 4,011,853 | 3/1977 | Fletcher | 124/87 |
| 4,224,741 | 9/1980 | Perry | 33/265 |
| 4,417,403 | 11/1983 | Strange | 33/265 |
| 4,418,479 | 12/1983 | Stachnik | 33/265 |

FOREIGN PATENT DOCUMENTS

| | | | |
|---|---|---|---|
| 337840 | 11/1930 | United Kingdom | 33/426 |

*Primary Examiner*—Richard C. Pinkham
*Assistant Examiner*—Benjamin Layno
*Attorney, Agent, or Firm*—James D. Givnan, Jr.

[57] ABSTRACT

A bow sight particularly suited for use on bows wherein the draw rating and hence arrow trajectory may be varied. A base of the sight has a forward extension on which is pivotally mounted a carrier having a sighting post. The base extension also supports a bridge having an inclined surface provided with elevation indices visible to the archer during aiming of the bow. The base extension and the carrier jointly provide stop means to retain the carrier and its sighting post in a selected elevation setting. A stop element is positionable within one of a series of recesses in the base extension corresponding to the bow draw rating. The stop element is sequentially engageable with a multitude of radially grooves formed in the carrier. Vertical adjustment of the carrier is through an arc the magnitude of which arc and the distance between carrier elevational settings being determined by the distance of the stop element from the carrier pivotal axis.

8 Claims, 4 Drawing Figures

BOW SIGHT

BACKGROUND OF THE INVENTION

The present invention pertains to the sport of archery and particularly to a bow sight which may be adjusted for changes in the pull or draw rating of a bow.

In the present art are various bow sights which include a bow mounted base and a vertically positionable post settable for different target distances with raising or lowering of the post resulting in desired arrow trajectory. Such sights are not readily adaptable to changes in the draw rating in pounds of a bow as is currently possible with modern bows of the compound type. With known bow sights any change in a bow's draw rating would entail considerable effort in the re-sighting in of the altered bow for the full range of target with distances.

SUMMARY OF THE PRESENT INVENTION

The present invention is embodied in a bow sight having a sighting post vertically adjustable in increments which increments may be varied in magnitude as the draw rating of the bow is altered.

The invention briefly includes a base for mounting on a bow with a base extension receiving a swingably mounted carrier on which is carried a post sight member. The sight member is registerable with a selected target range number printed on a bridge. The post carrier is held in place by stop means. Accordingly the post equipped carrier will have a vertical arc of incremental travel the magnitude of which increments may be altered by adjustment of the stop means. The sight when set for a 55 pound draw rating will enable the post equipped carrier to swing through a greater incremental arc (for a wide variation in arrow trajectories) than when the sight (and bow) is set for an 80 pound draw rating resulting in the post equipped carrier swinging through a lesser arc since arrow trajectories will be flatter.

The sight post is also adjustably mounted on the carrier.

The bridge is provided with a beveled surface on which are displayed numbers indicating target distances which numbers are visible to the archer when the bow is held in an operative position.

Important objectives of the present invention include the provision of an archery bow site which can accommodate changes in the bow draw rating and hence changes in arrow trajectories for the same target distance; the provision of a bow sight particularly suited for use on adjustable compound bows having variable ratings in pounds of draw or pull; the provision of a bow sight readily adaptable to right or left handed archers; the provision of a bow site wherein printed target distances on the sight are visible to the archer at all times before arrow release to permit sighting changes immediately prior to arrow release; the provision of a bow site readily mountable on compound bows without bow modification.

DETAILED DESCRIPTION OF THE PREFERRED EMBODIMENTS

Figure 1:
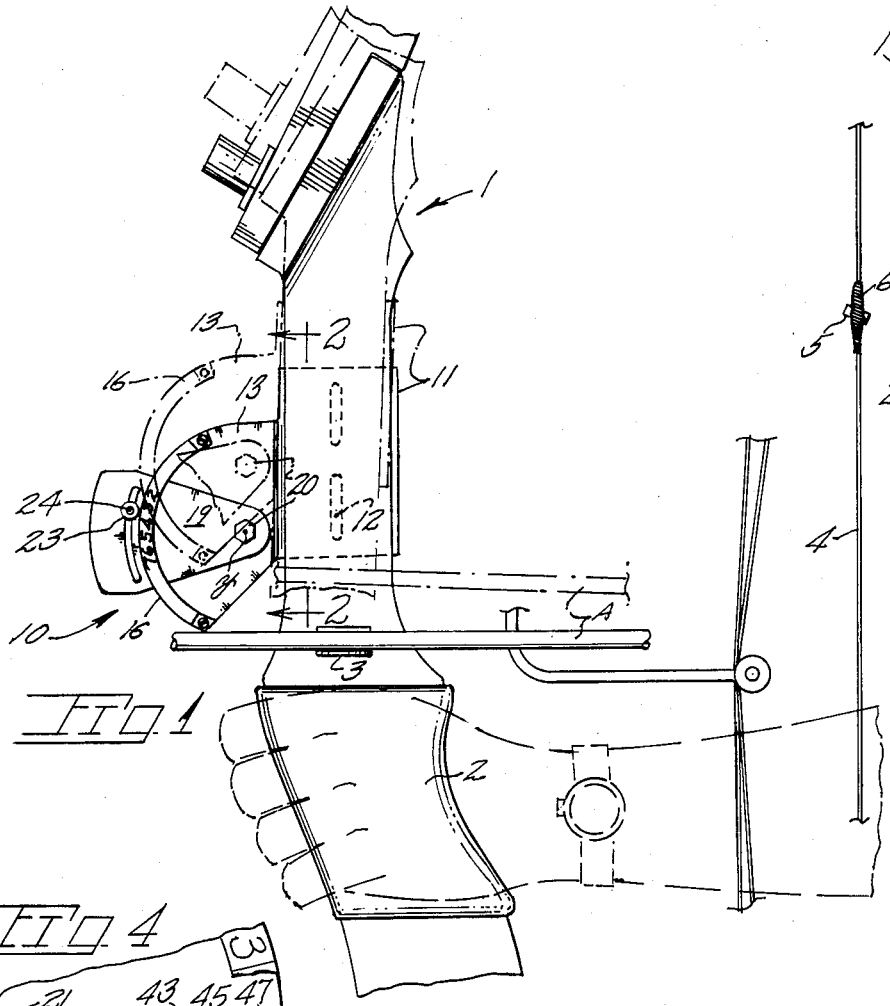
FIG. 1 is a fragmentary side elevational view of a bow with the present sight thereon.
Figure 2:
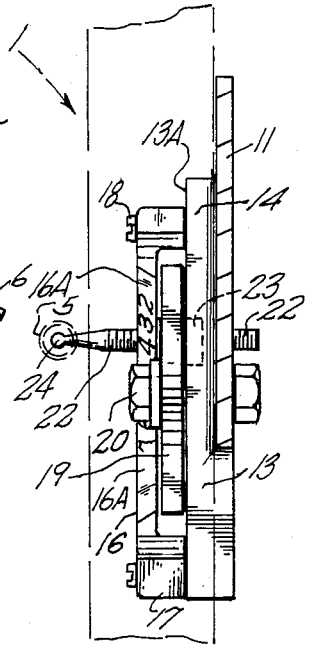
FIG. 2 is a vertical sectional view taken along line 2—2 of FIG. 1.

With continuing attention to the drawing, the applied reference numeral 1 indicates generally an archery bow shown as being of the compound type.

Present day compound archery bows have the capability of being adjustable to enable the archer to vary the pull or draw rating in pounds of the bow. The present bow sight is most advantageously utilized in conjunction with such a bow but not exclusively so.

A bow handgrip is at 2 while an arrow at A is supported by a rest at 3. A bowstring at 4 is shown at its static position and includes a peep sight 5 suitably secured to the bowstring as by a winding 6. The peep sight is located on the bowstring in the usual manner so as to be proximate the sighting eye of the archer when the bow is fully drawn. Use of the peep sight 5 with the present sight is advantageous.

The present sight is indicated generally at 10 secured to the bow above handgrip 2. A base 11 of the sight is slotted at 12 to permit base attachment by a pair of fasteners commonly used to hold a quiver bracket in place on the bow. Base 11 has a forward extension 13 of greater thickness than base 11 with a shoulder indicated at 14. The extension is bounded forwardly by a curved edge 15. A bridge 16 overlies the forward boundary of the extension with bridge ends 17 being abutment with surface 13A of base projection 13. Fasteners 18 secure the bridge in place. A beveled surface 16A of the bridge is inclined inwardly and downwardly to provide an inclined area visible to the archer during shooting and on which are displayed numbers for example two through seven which represent target ranges of twenty through seventy yards.

A sighting post carrier at 19 is swingably mounted on base extension 13 by a fastener assembly 20 which extends through an aperture 21 in the extension. The post carrier is generally of quadrantal shape with a horizontal axis of rotation at y coaxial with fastener assembly 20. A slot at 19A in carrier 19 is of arcuate shape and formed about said horizontal axis. A sighting post 22 extends through said slot and is adjustable therealong and lockable in place by nut elements 23 oppositely engageable with the carrier surfaces. Sighting post 22 has a bead 24 which is used preferably in conjunction with peep sight 5 to aim the bow.

Figure 3:
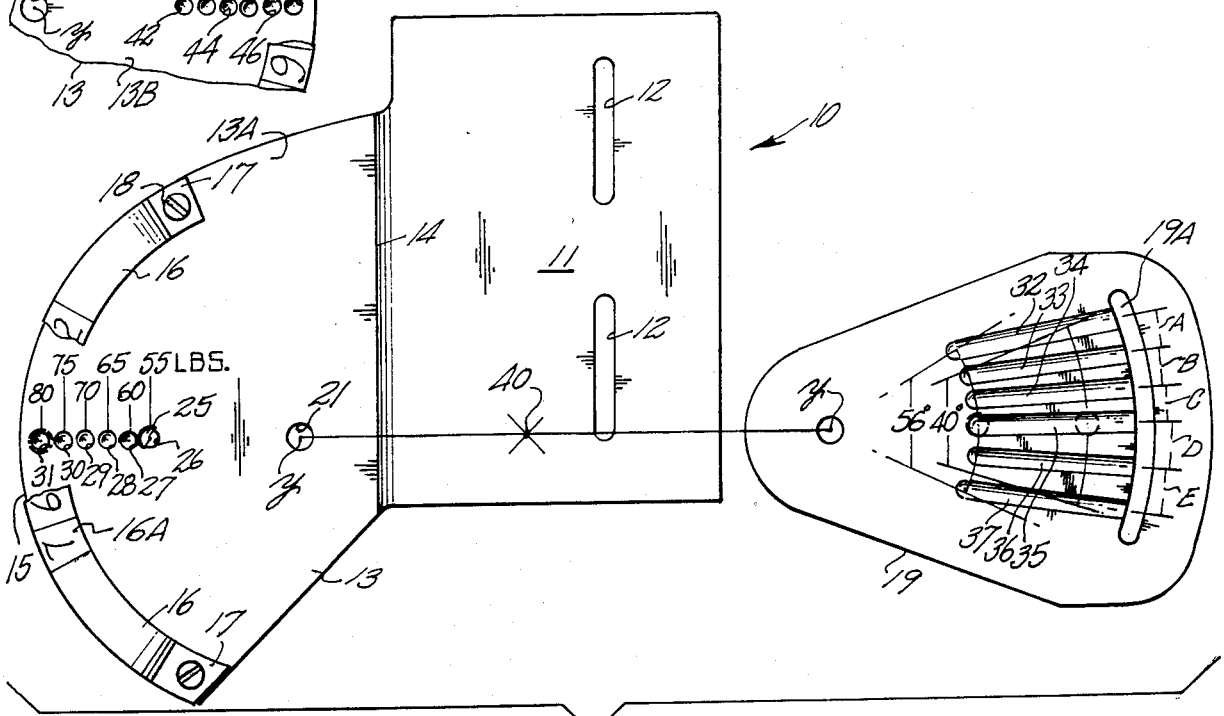
FIG. 3 is an exploded view of the base and carrier of the present sight with the carrier turned end-for-end.

The movable post carrier 19 permits elevational positioning of the sighting post for various target distances. A stop element at 25 is shown as a ball positionable for retention in one of several recesses at 26, 27, 28, 29, 30 and 31 each spaced a different distance from axis y. The stop element extends above surface 13A of projection 13. A series of non-parallel vertically spaced grooves at 32, 33, 34, 35, 36 and 37 are formed along radials from a center indicated at 40. An exposed portion of stop element 25 can seat within each of said grooves to retain the carrier in selected positions about axis y. For purposes of illustration only, multiple stop elements 25 are shown in phantom lines in FIG. 3 in certain grooves to indicate the different ranges of carrier travel as determined by the recess location of the stop element i.e., in a recess 26–31. The phantom line stop elements nearest axis y of carrier indicate that with stop element 25 located in recess 26, the carrier will have a range of arcuate travel of 56 degrees or so. Placement of stop element 25 in recess 31 will limit arcuate travel of the carrier to 40 degrees or so of travel.

Recess 26 is the proper stop element location when the bow is adjusted to a draw rating of 55 pounds while recess 31 is the proper stop element location when the bow is set at an 80 pound bow rating. Bow ratings are embossed on surface 13A for the sake of convenience. The carrier defined grooves between the outermost grooves 32 and 37 each, in conjunction with stop element 25, provide a stop for carrier 19 with both the cumulative and incremental travel of the carrier being greater with stop element in recess 26 than it is with the stop element being located in recess 31 or any of the intermediate recesses 27–30. The reduced incremental travel of the carrier and sighting post 22 with the stop element in recess 31 is appropriate in view of the flatter trajectories of a bow adjusted to an 80 pound pull.

In one satisfactory embodiment of the present bow sight, the recesses 26–31 are formed on 0.100 of an inch centers with the center of recess 26 being one inch from axis y. Grooves 32–37 are located on radials from center 40 with the outer extremity of each groove terminating at slot 19A formed on a two inch radius from axis y. Axis y is spaced two inches from center 40. The dimension indicated at A through E are the distances between groove centers at the groove extremities with A=0.200; B=0.210; C=0.221; D=0.242; E=0.275.

Figure 4:
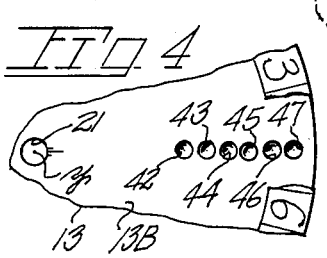
FIG. 4 is a fragmentary elevational view of the remaining side of the base extension.

Carrier 19 and base extension 13 are preferably machined on both vertical surfaces to provide a sight adapted for use by either a right or left handed archer. FIG. 4 shows the reverse side 13B of the base extension provided with recesses 42, 43, 44, 45, 46 and 47 in which the stop element 48 may be selectively placed. The reverse side of carrier 19 would be a mirror image of the carrier shown in FIG. 3. The bridge 16, when relocated on surface 13B, would require transposing of the range numerals 16A.

In use the sight is correctly set for the draw string i.e., the ball element placed in the proper recess 27–31. The sight post is adjusted along slot 19A to correctly indicate the elevation for a target at a distance indicated by one of the numerals 16A. With one such sighting in for a medium range distance the remaining elevational positions of the carrier and sight post will be correct without readjustment of sight post along slot 19A.

While we have shown but one embodiment of the invention it will be apparent to those skilled in the art that the invention may be embodied still otherwise without departing from the spirt and scope of the invention.

Having thus described the invention, what is claimed and desired to be secured in Letters Patent is:

1. A bow sight comprising, a base for securement to the bow, a carrier including a sighting post, means pivotally mounting said carrier on said base for movement about a horizontal axis, and stop means carried by said base and said carrier to retain the carrier and sighting post thereon in a preselected elevational position, a plurality of recesses defined on said base, and each positioned at spaced apart locations from said horizontal axis, a stop element selectively positionable in one of said recesses and hence at spaced apart locations from said horizontal axis, a plurality of grooves defined on said carrier and arranged in non-parallel fashion and sequentially engageable with said stop element during carrier movement to maintain said carrier and sighting post thereon in a selected position of elevation with the magnitude of carrier travel between successive positions affected by the spatial relationship of said stop element to said horizontal axis.

2. The bow sight claimed in claim 1 wherein said sighting post is adjustably mounted in a slot defined by said carrier.

3. The bow sight claimed in claim 1 additionally including a bridge on said base, said bridge including a beveled surface visible to the archer when the bow is in an operative position with numbers on said beveled surface indicating elevational settings for the sighting post.

4. The bow sight claimed in claim 3 additionally including a peep sight member adapted to be carried by the bowstring of the bow.

5. The bow sight claimed in claim 1 wherein said base and said carrier each define recesses and grooves on two opposite surfaces to permit relocation of the carrier on said base to provide a bow sight adaptable to both right and left hand archers.

6. The bow sight claimed in claim 1 wherein said grooves are on radials of a common center.

7. The bow sight claimed in claim 6 wherein said grooves are on non-uniformly spaced radials.

8. A bow sight comprising, a base for securement to the bow, a carrier including a sighting post, means pivotally mounting said carrier on said base for movement about a horizontal axis, and stop means carried by said base and said carrier to retain the carrier and sighting post thereon in a preselected elevational position, said stop means including a stop element confined between said base and said carrier and positionable at selected spaced apart locations from said horizontal axis, stop element receiving recesses in said base located at different distances from said horizontal axis, vertically spaced means arranged in non-parallel diverging fashion and sequentially engageable with said stop element during carrier movement to maintain said carrier and sighting post thereon in a selected position elevation with the magnitude of carrier travel between successive positions affected by the selective positioning of said stop element in one of said recesses at a certain distance from said horizontal axis.

* * * * *